US011016425B2

(12) United States Patent
Tsuchihashi et al.

(10) Patent No.: US 11,016,425 B2
(45) Date of Patent: May 25, 2021

(54) IMAGE HEATING DEVICE AND IMAGE FORMING APPARATUS

(71) Applicant: CANON KABUSHIKI KAISHA, Tokyo (JP)

(72) Inventors: Naoto Tsuchihashi, Yokohama (JP); Hideaki Yonekubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/847,867

(22) Filed: Apr. 14, 2020

(65) Prior Publication Data

US 2020/0333733 A1 Oct. 22, 2020

(30) Foreign Application Priority Data

Apr. 16, 2019 (JP) ..... JP2019-078025

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 10,520,866 | B2 | 12/2019 | Nomura et al. | |
| 10,635,033 | B2 | 4/2020 | Tsuchihashi et al. | |
| 2018/0004134 | A1* | 1/2018 | Nomura | G03G 15/2017 |
| 2020/0166876 | A1 | 5/2020 | Yonekubo | |

FOREIGN PATENT DOCUMENTS

| | | | |
|---|---|---|---|
| JP | 2007-271870 | A | 10/2007 |
| JP | 2015-114591 | A | 6/2015 |
| JP | 2018-124476 | A | 8/2018 |

OTHER PUBLICATIONS

Co-pending U.S. Appl. No. 16/830,355, filed Mar. 26, 2020.
Co-pending U.S. Appl. No. 16/853,919, filed Apr. 21, 2020.

* cited by examiner

*Primary Examiner* — Clayton E. LaBalle
*Assistant Examiner* — Michael A Harrison
(74) *Attorney, Agent, or Firm* — Venable LLP

(57) ABSTRACT

In a case where an image formed on a recording material includes a contiguous image portion formed across a plurality of heating regions at a given density, power supplied to a plurality of heating elements that heat the plurality of heating regions is controlled by correcting respective control heating amounts of the plurality of heating regions set in accordance with respective maximum densities of image regions resulting from dividing the image into the plurality of heating regions, so that a difference between a maximum value and a minimum value of the control heating amounts among the plurality of heating regions in which the image portion is heated from among the plurality of heating regions, lies within a predetermined range.

7 Claims, 12 Drawing Sheets

IMAGE HEATING DEVICE AND IMAGE FORMING APPARATUS

BACKGROUND OF THE INVENTION

Field of the Invention

The present invention relates to a fixing unit mounted on an image forming apparatus such as a copier or printer that utilizes an electrophotographic system or an electrostatic recording system, and to an image heating device such as a gloss imparting device for increasing a gloss value of a toner image through re-heating of a toner image already fixed on a recording material. Further, the present invention relates to a heating control method that is utilized in the image heating device.

Description of the Related Art

Image heating devices that have an endless fixing film, a heater that is in contact with an inner surface of the fixing film, and pressure rollers that form a nip with the heater, via the fixing film, are conventionally known as image heating devices utilized in image forming apparatuses. The heat capacities of the heater and the fixing film in such image heating devices are small, and accordingly these devices are superior in quick start performance (shortness of the time for raising the temperatures of the heater and of the fixing film and power saving (little power consumed in order to raise the temperatures of the heater and of the fixing film). However, the demands placed on image heating devices in terms of delivering greater power savings have increased in recent years.

Therefore, in the image heating device disclosed in Japanese Patent Application Publication No. 2007-271870 power consumed by the image heating device is saved through selective heating of a recording material having a toner image formed thereon. Specifically, in the image heating device disclosed in Japanese Patent Application Publication No. 2007-271870 a heating region in a nip portion in which an image formed on the recording material is heated is divided into a plurality of heating regions, in a direction perpendicular to the transport direction of the recording material. A control target temperature in heating of the plurality of heating regions by a plurality of heating elements is set for each of the plurality of heating regions, in accordance with image information about an image portion corresponding to each of the heating regions in the image formed on the recording material. Power consumed by the image heating device is saved as a result.

In the image heating device disclosed in Japanese Patent Application Publication No. 2007-271870, in a case where an image is formed continuously across adjacent heating regions and respective heating temperatures set in the adjacent heating regions are largely different from each other, significant differences may arise in gloss within the continuous image. A gloss level difference arises specifically at the boundaries between adjacent heating regions, within the continuous image, on account of differences in the respective amounts of generated heat (control target temperatures) at the adjacent heating regions.

Japanese Patent Application Publication No. 2018-124476 proposes an image heating device wherein, in a case where the respective heating temperatures set for adjacent heating regions are different from each other, differences in heating temperature between adjacent heating regions are adjusted so as not to be greater than a specified amount, to ease level differences in gloss and maintain power saving.

SUMMARY OF THE INVENTION

Controlling the energization of heating elements under heating conditions that are optimal for an image in heating regions, by resorting to the method disclosed in Japanese Patent Application Publication No. 2018-124476, gives rise herein to problems such as those set out below.

An explanation follows next on an image forming apparatus in which heating control is performed such that a control target temperature for an image portion in which a value of density information (hereafter image density) as image information is large (large toner amount) is higher than the heating temperature of an image portion in which the value of image density is low (small toner amount).

FIG. 12A is a diagram illustrating an example of three heating regions X, Y, Z resulting from dividing a recording material in the longitudinal direction of a substrate, perpendicular to the transport direction of the recording material, and of images PIC 1, PIC 2 formed at the heating regions X, Y, Z.

FIG. 12B is a schematic diagram illustrating control target temperatures of the heating regions as determined on the basis of image density information acquired for each divisional region resulting from dividing the image into the heating regions, at the time of outputting of the image of the FIG. 12A.

FIG. 12C is a schematic diagram illustrating control target temperatures of respective heating regions at the time of output of the image of FIG. 12A, when using, in contrast to FIG. 12B, the method disclosed in Japanese Patent Application Publication No. 2018-124476.

The image density of image PIC 2 takes on a higher value of image density than image PIC 1. In a case where the method disclosed in Japanese Patent Application Publication No. 2018-124476 is resorted to, therefore, the control target temperature of heating region Z is set to a high temperature in accordance with the value of image density of image PIC 2, and the control target temperature of heating region X is set to a low temperature, in accordance with the value of image density of image PIC 1. Meanwhile, the control target temperature in heating region Y according to the image density of image PIC 1 is adjusted and set so that a difference with respect to the control target temperature of heating region Z is smaller than a specified value. The level difference in gloss between heating region Y and heating region Z becomes eased through such an adjustment of the control target temperature. In image PIC 1, however, a large difference in control target temperature remains between heating region X and heating region Z, despite the fact that the image pattern of image PIC 1 is formed with uniform image density, not only between heating region Y and heating region Z but also up to heating region X. In consequence, a noticeable gloss difference may arise between heating region X and heating region Z within image PIC 1, which is an image pattern of uniform image density.

It is an object of the present invention to provide a technique that allows reducing, more effectively, gloss differences at image portions that are formed contiguously across a plurality of heating regions.

To attain the above goal, an image heating device of the present invention, comprising:

a heating unit including a heater for heating an image formed on a recording material, wherein the heater includes a substrate, and a plurality of heating elements dividedly provided on the substrate in a direction perpendicular to a transport direction of the recording material; and a control portion that controls power that is supplied to the plurality of heating elements, wherein the control portion acquires density information about the image for each of image regions resulting from dividing the image into a plurality of heating regions that are heated by the plurality of heating elements, sets respective control heating amounts for the plurality of heating regions, based on the acquired density information, and controls the power, wherein in a case where the image includes a contiguous image portion formed across two or more of the plurality of heating regions at a given density, the control portion controls the power by correcting the respective control heating amounts for the plurality of heating regions set in accordance with respective maximum densities of the image regions resulting from dividing the image into the plurality of heating regions, so that a difference between a maximum value and a minimum value of the control heating amounts among the two or more of the plurality of heating regions in which the image portion is heated from among the plurality of heating regions, lies within a predetermined range.

To attain the above goal, an image forming apparatus of the present invention, comprising:

an image forming portion which forms an image on a recording material; and a fixing portion which fixes, to the recording material, the image formed on the recording material, the fixing portion comprising:

a heating unit including a heater for heating an image formed on a recording material, wherein the heater includes a substrate, and a plurality of heating elements dividedly provided on the substrate in a direction perpendicular to a transport direction of the recording material; and a control portion that controls power that is supplied to the plurality of heating elements, wherein the control portion acquires density information about the image for each of image regions resulting from dividing the image into a plurality of heating regions that are heated by the plurality of heating elements, sets respective control heating amounts for the plurality of heating regions, based on the acquired density information, and controls the power, wherein in a case where the image includes a contiguous image portion formed across two or more of the plurality of heating regions at a given density, the control portion controls the power by correcting the respective control heating amounts for the plurality of heating regions set in accordance with respective maximum densities of the image regions resulting from dividing the image into the plurality of heating regions, so that a difference between a maximum value and a minimum value of the control heating amounts among the two or more of the plurality of heating regions in which the image portion is heated from among the plurality of heating regions, lies within a predetermined range.

The present invention allows reducing, more effectively, gloss differences at image portions that are formed contiguously across a plurality of heating regions.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Configuration of an Image Forming Apparatus

Figure 1:
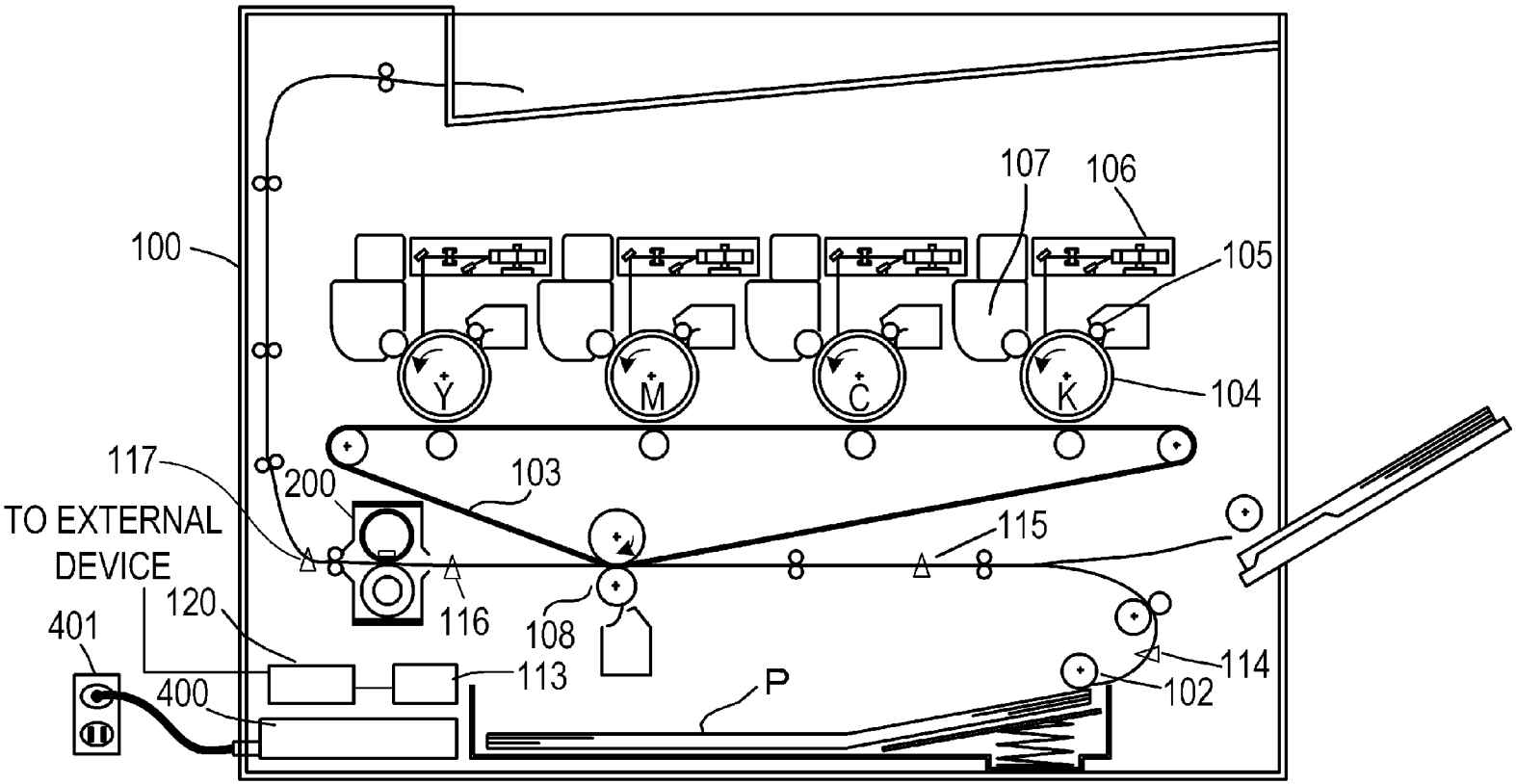
FIG. 1 is a cross-sectional diagram of an image forming apparatus.

FIG. 1 is a schematic cross-sectional diagram illustrating an exemplary configuration of an image forming apparatus of an electrophotographic system according to an embodiment of the present invention. Examples of the image forming apparatus in which the present invention can be used include copiers, printers and the like that utilize an electrophotographic system or an electrostatic recording system. An instance will be explained herein in which the present invention is used in a laser printer for forming an image on a recording material P, through the use of an electrophotographic system.

A video controller 120 receives and processes image information and a print instruction transmitted from an external device such as a personal computer. A control portion 113, which is connected to the video controller 120, controls various portions that make up the image forming apparatus, in accordance with an instruction from the video controller 120. Image formation is performed in accordance with the operation below when the video controller 120 receives a print instruction from an external device.

In the image forming apparatus 100 the recording material P is fed by means of a feed roller 102, to transport the recording material P towards an intermediate transfer member 103. Each photosensitive drum 104 is rotationally driven counterclockwise, at a predetermined speed, by way of the power of a drive motor (not shown), and becomes uniformly charged by a respective primary charging device 105 during this rotation process. A laser beam modulated in accordance with an image signal is outputted from a respective laser beam scanner 106, to form an electrostatic latent image through selective scanning exposure of the photosensitive drum 104. In the developing device 107 a visible image is formed as a toner image (developer image), through adhesion of a powder toner, which is a developer, on the electrostatic latent image having been formed on the photosensitive drum 104. The toner image formed on each photosensitive drum 104 undergoes primary transfer onto the intermediate transfer member 103 that rotates while in contact with the photosensitive drum 104.

Herein the photosensitive drum 104, the primary charging device 105, the laser beam scanner 106 and the developing device 107 are each disposed for four colors, namely yellow (Y), magenta (M), cyan (C) and black (K). The toner images of the four respective colors are sequentially transferred, superimposed on each other, onto the intermediate transfer member 103, in accordance with the same procedure. The toner image transferred onto the intermediate transfer member 103 undergoes then secondary transfer onto the recording material P on account of transfer bias applied to transfer rollers 108, at a secondary transfer section formed by the intermediate transfer member 103 and the transfer rollers 108. Thereafter, a fixing apparatus 200 as a fixing portion (image heating portion) heats up and presses the recording material P, as a result of which the toner image becomes fixed, being then discharged out of the equipment in the form of an image-formed product.

In the above configuration, the structure pertaining to the process up to formation of an unfixed toner image on the recording material corresponds to the image forming portion of the present invention.

The image forming apparatus 100 of the present embodiment conforms to a plurality of recording material sizes, and is configured in such a manner that recording materials of various sizes can be set in a paper feeding cassette 11. Examples of recording materials that can be printed (that allow for image formation) include Letter paper (about 216 mm×279 mm), Legal paper (about 216 mm×356 mm), A4 paper (210 mm×297 mm) and Executive paper (about 184 mm×267 mm). Also B5 paper (182 mm×257 mm) and A5 paper (148 mm×210 mm) can be printed herein. Moreover, non-regular paper as DL envelopes (110 mm×220 mm), and COM10 envelopes (about 105 mm×241 mm) can likewise be printed.

The image forming apparatus 100 of the present embodiment is a laser printer in which basically a recording material is fed longitudinally (transported so that the long sides of the material are parallel to the transport direction). The largest size (largest width) of standard recording material (widths of corresponding recording material on the catalog) supported by the apparatus is herein a width of about 216 mm, which is that of Letter paper and Legal paper.

The control portion 113 manages the transport situation of the recording material P by means of a transport sensor 114, a registration sensor 115, a pre-fixing sensor 116 and a fixing discharge sensor 117, on the transport path of the recording material P. The control portion 113 has a storage portion that stores for instance a temperature control program and a temperature control table of the fixing apparatus 200. The control portion 113 controls the temperature of the fixing apparatus 200 on the basis of image information received from the video controller 120, in accordance with the method described below.

A control circuit 400 as a heater driving portion connected to a commercial AC power source 401 supplies power to the fixing apparatus 200.

2. Configuration of an Image Heating Device

Figure 2:
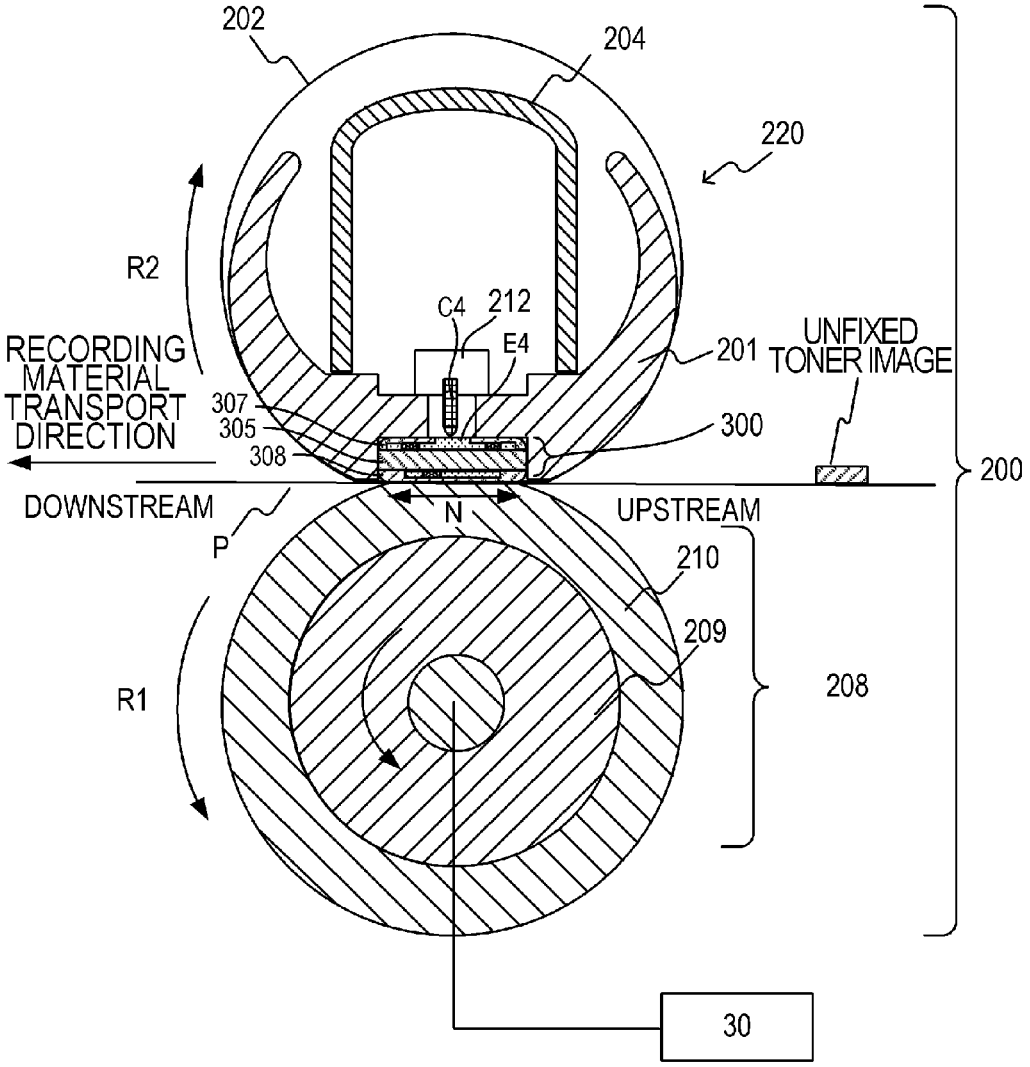
FIG. 2 is a cross-sectional diagram of an image heating device of an embodiment.

FIG. 2 is a schematic cross-sectional diagram of a fixing apparatus 200 as an image heating device of the present embodiment. The fixing apparatus 200 has a fixing film 202 as an endless belt, a heater 300, a pressure roller 208 that forms a fixing nip N together with the heater 300, across the fixing film 202, and a metal stay 204.

The fixing film 202 is a multilayer heat-resistant film having flexibility and formed to a tubular shape, and in which a heat-resistant resin such as a polyimide, having a thickness of about 50 to 100 μm, or a metal such as stainless steel having a thickness of about 20 to 50 μm, can be used as a base layer. The surface of the fixing film 202 is coated with a release layer for preventing toner adhesion and ensuring separability from the recording material P. The release layer is formed of a heat-resistant resin exhibiting superior releasability, such as a tetrafluoroethylene/perfluoroalkylvinyl ether copolymer (PFA), having a thickness of about 10 to 50 μm. Further, heat-resistant rubber such as silicone rubber having a thickness of about 100 to 400 μm and thermal conductivity of about 0.2 to 3.0 W/m·K may be provided as an elastic layer between the above base layer and the release layer, in order to enhance image quality in particular in an apparatus in which color images are formed.

In the present embodiment, a polyimide having a thickness of 60 μm is used as the base layer, silicone rubber having a thickness of 300 μm and thermal conductivity of 1.6 W/m·K is used as an elastic layer, and PFA having a thickness of 30 μm is used as the release layer, for instance from the viewpoint of thermal responsiveness, image quality and durability.

The pressure roller 208 has a metal core 209 of a material such as iron or aluminum, and an elastic layer 210 of a material such as silicone rubber. The fixing film 202 is heated by the heater 300, which is held on a heater holding member 201 made of a heat-resistant resin. The heater holding member 201 has also a guiding function of guiding the rotation of the fixing film 202. The metal stay 204 receives a pressing force, not shown, and urges as a result the heater holding member 201 towards the pressure roller 208. The pressure roller 208 rotates in the direction of arrow R1, by receiving power from the motor 30. The fixing film 202 rotates in the direction of arrow R2, in response to the rotation of the pressure roller 208. At the fixing nip N the unfixed toner image on the recording material P undergoes a fixing process, through application of heat from the fixing film 202, while the recording material P is transported in a pinched fashion.

The heater 300 is a heater in which heating resistors provided on a ceramic substrate 305 generate heat. The heater 300 has a surface protective layer 308 provided on the side of the fixing nip N and a surface protective layer 307 provided on the reverse side from that of the fixing nip N. A plurality of electrodes (herein electrode E4 is illustrated as an example thereof) and electrical contacts (herein electrical contact C4 is illustrated as an example thereof) are provided on the reverse side from that of the fixing nip N, such that each electrode is fed power from a respective electrical contact. The details of the heater 300 will be described below with reference to FIG. 3.

A safety element 212 such as a thermoswitch or thermal fuse that is triggered by abnormal heat generation in the heater 300 and which thereupon cuts off the power supplied to the heater 300 is in contact with the heater 300, directly or indirectly via the heater holding member 201. A heating unit 220 being in contact with an inner surface of the fixing film 202 includes the heater 300, the heater holding member 201, and the metal stay 204.

3. Heater Configuration

Figure 3A:
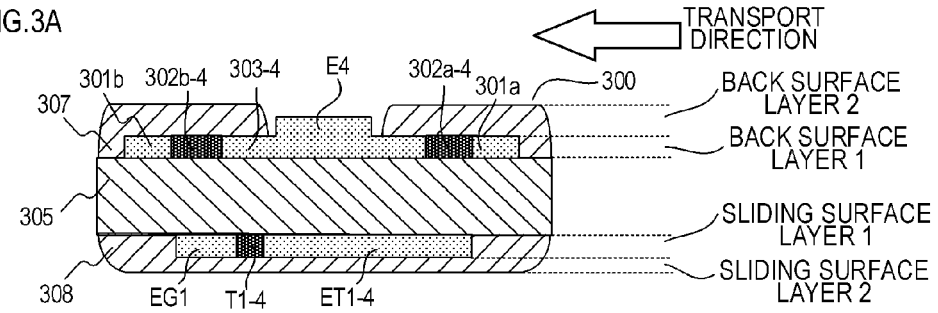
FIGS. 3A, 3B, and 3C are a set of heater configuration diagrams of an embodiment.
Figure 3B:
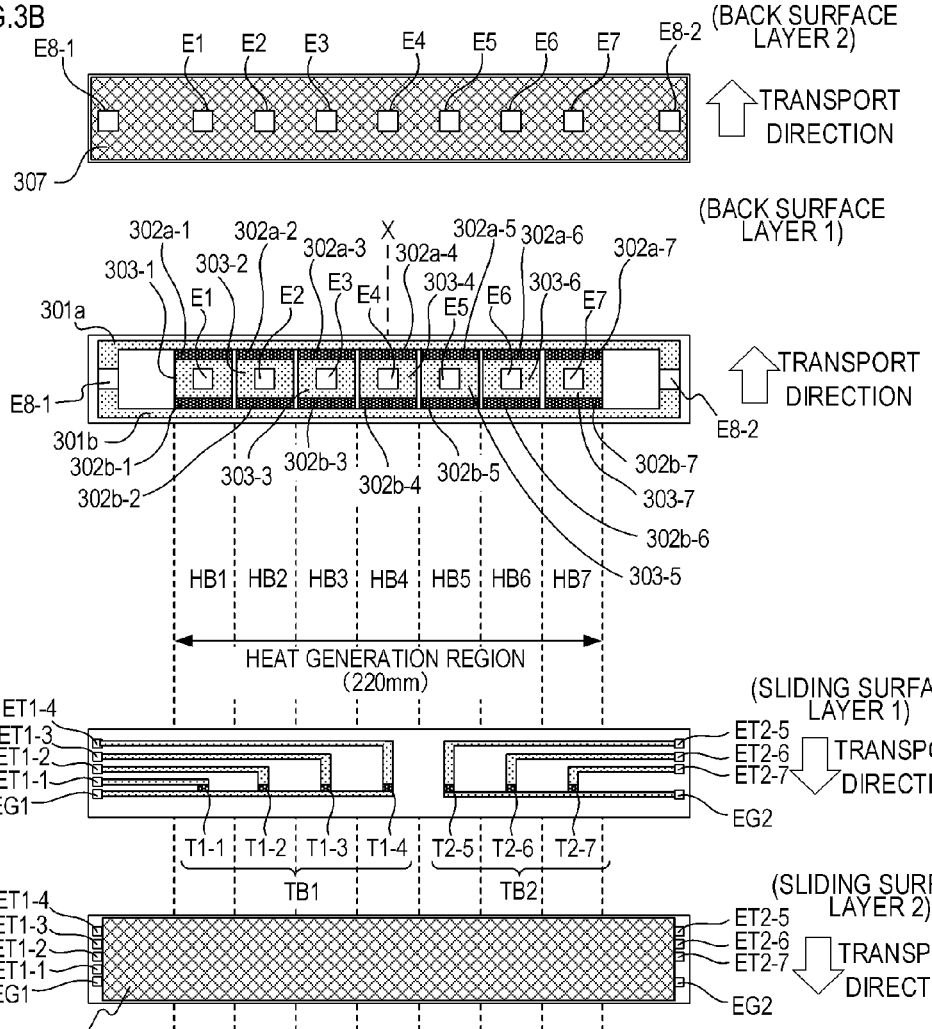

FIG. 3 is a set of schematic diagrams illustrating the configuration of the heater 300 of Embodiment 1. FIG. 3A illustrates a cross-sectional diagram of the vicinity of a transport reference position X illustrated in FIG. 3B. The transport reference position X is defined as a reference position during transport of the recording material P. In the present embodiment the recording material P is transported so that a central portion thereof, in a direction perpendicular to the transport direction of the recording material P, passes the transport reference position X.

The longitudinal direction of the heater 300 (substrate 305) coincides with a direction perpendicular to the transport direction of the recording material P.

The heater 300 has first conductors 301 (301*a*, 301*b*), and second conductors 303 (303-1 to 303-7; 303-4 in the vicinity of the transport reference position X) on the back surface layer-side surface of the substrate 305. The first conductors 301 are provided along the longitudinal direction of the heater 300, on the back surface layer-side of the substrate 305. The second conductors 303 are provided along the longitudinal direction of the heater 300 at positions, in the transverse direction (direction perpendicular to the longitudinal direction) of the heater 300, different from those of the first conductors 301, on the back surface layer-side of the substrate 305. The first conductors 301 are separated into a conductor 301*a* disposed upstream, and a conductor 301*b* disposed downstream, in the transport direction of the recording material P. Further, the heater 300 has heating resistors 302 (302*a*-1 to 302*a*-7, 302*b*-1 to 302*b*-7) as heating elements that generate heat when energized. The heating resistors 302 are provided between the first conductors 301 and the second conductors 303, on the back surface layer-side surface of the substrate 305, and generate heat from power that is supplied via the first conductors 301 and the second conductors 303.

In the present embodiment the heating resistors 302 are separated into heating resistors 302*a* (302*a*-4 in the vicinity of the transport reference position X) disposed upstream and heating resistors 302*b* (302*b*-4 in the vicinity of the transport reference position X) disposed downstream, in the transport direction of the recording material P. An insulating surface protective layer 307 (of glass in the present embodiment) that covers the heating resistors 302, the first conductors 301 and the second conductors 303 is provided, on a back surface layer 2 of the heater 300, avoiding an electrode portion E (E1 to E7, E8-1 and E8-2; herein E4 in the vicinity of the transport reference position X).

FIG. 3B illustrates a plan-view diagram of the various layers of the heater 300. A plurality of heat generation blocks made up of respective sets of first conductors 301, second conductors 303 and heating resistors 302, are provided on a back surface layer 1 of the heater 300 in the longitudinal direction of the heater 300 (substrate 305). The heater 300 of the present embodiment has a total of seven heat generation blocks $HB_1$ to $HB_7$ in the longitudinal direction thereof. The heat generation blocks $HB_1$ to $HB_7$ are respectively made up of heating resistors 302*a*-1 to 302*a*-7 and heating resistors 302*b*-1 to 302*b*-7, formed symmetrically in the transverse direction of the heater 300. The first conductors 301 are made up of the conductor 301*a* connected to heating resistors (302*a*-1 to 302*a*-7) and the conductor 301*b* connected to heating resistors (302*b*-1 to 302*b*-7). Similarly, the second conductors 303 correspond to seven heat generation blocks $HB_1$ to $HB_7$, and accordingly are divided into seven conductors 303-1 to 303-7.

In the present embodiment the heat generation blocks $HB_1$ to $HB_7$ have a collective width of 220 mm, the heat generation blocks $HB_i$ having each thus a width of 31.4 mm resulting from equal division by 7.

The electrodes E1 to E7, E8-1 and E8-2 are used for connection to electrical contacts C1 to C7, C8-1 and C8-2 that are in turn utilized in order to supply power from the below-described control circuit 400 of the heater 300. Each of the electrodes E1 to E7 is an electrode used for supply of power to the heat generation blocks $HB_1$ to $HB_7$ via the conductors 303-1 to 303-7, respectively. The electrodes E8-1 and E8-2 are electrodes used for connection to a common electrical contact utilized in order to supply power to the seven heat generation blocks $HB_1$ to $HB_7$, via the conductor 301*a* and the conductor 301*b*.

In the present embodiment the electrodes E8-1 and E8-2 are provided at both ends in the longitudinal direction, but a configuration may be adopted wherein for instance just the electrode E8-1 is provided on a single side; alternately, individual electrodes may be provided upstream and downstream in the recording material transport direction.

The surface protective layer 307 on the back surface layer 2 of the heater 300 is formed except at the sites of the electrodes E1 to E7, E8-1 and E8-2. In the present configuration, specifically, the electrical contacts C1 to C7, C8-1 and C8-2 can be connected to respective electrodes, from the back surface layer side of the heater 300, such that power can be supplied from the back surface layer side of the heater 300. This configuration allows controlling independently the power supplied to at least one of the heat generation blocks, and the power supplied to the other heat generation blocks, from among the heat generation blocks.

In order to detect the temperature of each of the heat generation blocks $HB_1$ to $HB_7$ of the heater 300, thermistors T1-1 to T1-4, T2-5 to T2-7 are installed on a sliding surface layer 1 of the heater 300, on a sliding surface side (surface in contact with the inward face of the fixing film 202). The thermistors T1-1 to T1-4, T2-5 to T2-7 are provided by thinly forming, on the substrate, a material having a PTC characteristic or NTC characteristic (NTC characteristic in the present embodiment). All the heat generation blocks $HB_1$ to $HB_7$ have herein respective thermistors, and hence the temperatures of all heat generation blocks can be detected through detection of the resistance values of the thermistors.

Conductors ET1-1 to ET1-4 for resistance value detection in the thermistors, and a common conductor EG1 of the thermistors, are formed in order to energize the four thermistors T1-1 to T1-4. A thermistor block TB1 becomes formed by a set of the conductors ET1-1 to ET1-4, the common conductor EG1, and the thermistors T1-1 to T1-4. Similarly, conductors ET2-5 to ET2-7 for resistance value detection in the thermistors, and a common conductor EG2 of the thermistors, are formed in order to energize the three thermistors T2-5 to T2-7. A thermistor block TB2 becomes formed by a set of the conductors ET2-5 to ET2-7, the common conductor EG2, and the thermistors T2-5 to T2-7.

The sliding surface layer 2 on the sliding surface side of the heater 300 has the surface protective layer 308 (of glass in the present embodiment) that exhibit slidability. The surface protective layer 308 is provided at least at a region of sliding on the film 202, excluding both end sections of the heater 300, in order to provide electrical contacts for the conductors ET1-1 to ET1-4, ET2-5 to ET2-7 and the common conductors EG1, EG2.

Figure 3C:
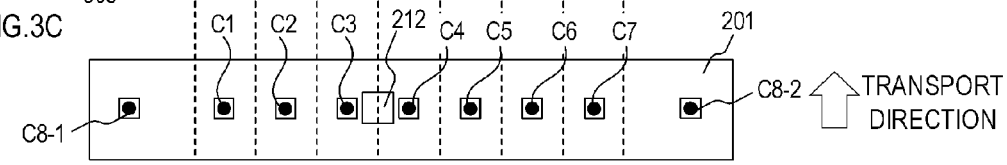

As illustrated in FIG. 3C, holes for connecting the electrodes E1 to E7, E8-1 and E8-2 and the electrical contacts C1 to C7, C8-1 and C8-2 are provided in the heater holding member 201 of the heater 300. The above-described safety element 212 and electrical contacts C1 to C7, C8-1 and C8-2 are provided between the stay 204 and the heater holding member 201. The electrical contacts C1 to C7, C8-1 and C8-2 in contact with the electrodes E1 to E7, E8-1 and E8-2 are electrically connected to an electrode portion of the heater, for instance in accordance with a method such as spring urging, or welding. The electrical contacts are connected to the below-described control circuit 400 of the heater 300 via a conductive material such as a cable or a thin metal plate provided between the stay 204 and the heater holding member 201. Also the electrical contacts provided in the conductors ET1-1 to ET1-4, ET2-5 to ET2-7 for resistance value detection in the thermistors and the common conductors EG1, EG2 of the thermistors are connected to the below-described control circuit 400.

4. Configuration of the Heater Control Circuit

Figure 4:
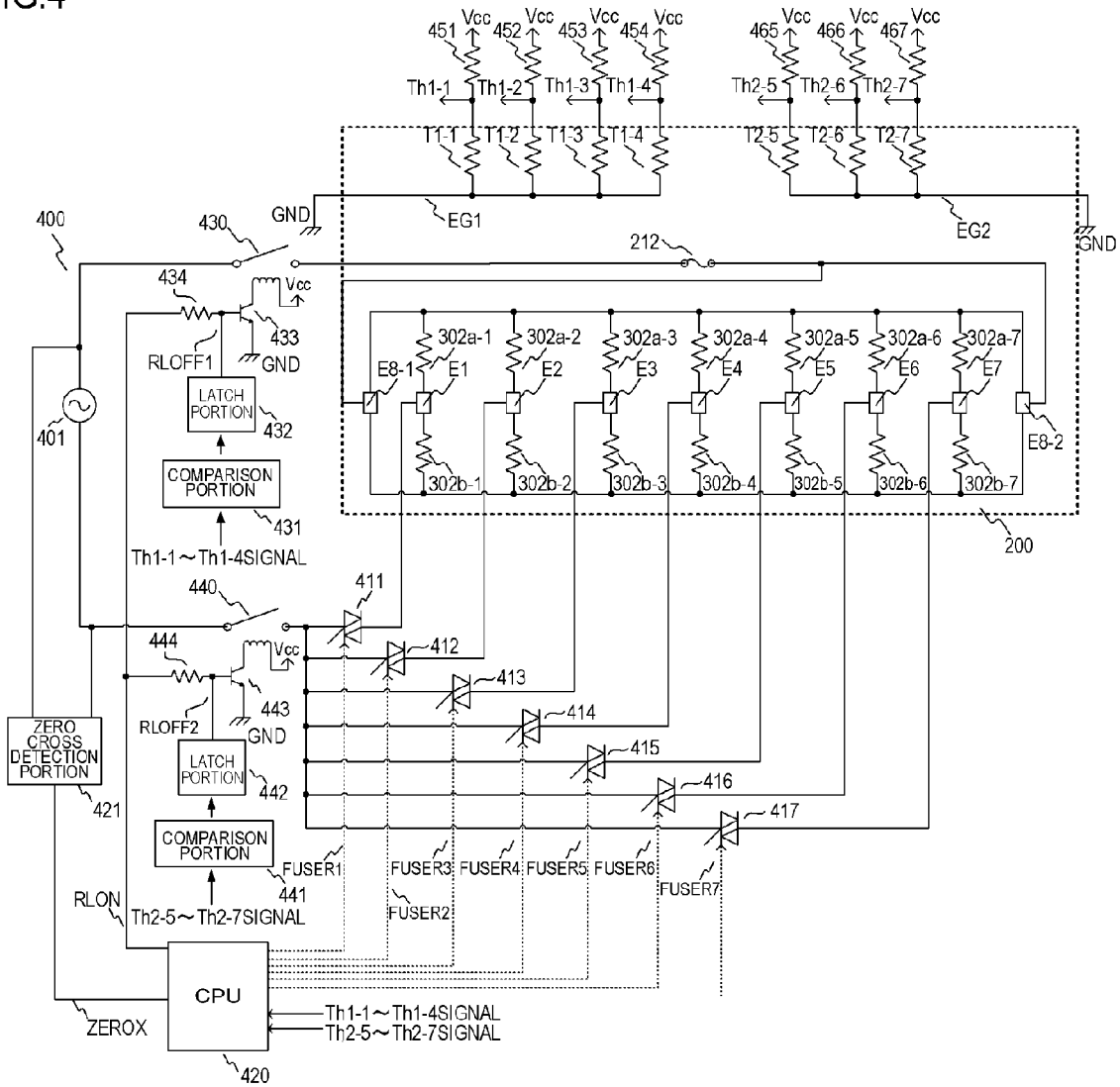
FIG. 4 is a heater control circuit diagram of an embodiment.

FIG. 4 illustrates a circuit diagram of the control circuit 400 of the heater 300 of Embodiment 1. The reference symbol 401 is a commercial AC power source connected to the image forming apparatus 100. Power control of the heater 300 is performed through energization/shutoff of triacs 411 to 417. The triacs 411 to 417 operate according to FUSER 1 to FUSER 7 signals, respectively, from the CPU 420. Drive circuits of the triacs 411 to 417 are not depicted.

The control circuit 400 of the heater 300 has a circuit configuration in which the seven heat generation blocks $HB_1$ to $HB_7$ can be controlled independently by the seven triacs 411 to 417.

A zero cross detection portion 421, which is a circuit for detecting zero cross of the AC power source 401, outputs a ZEROX signal to the CPU 420. The ZEROX signal is used for instance in phase control and detection of wavenumber control timing in the triacs 411 to 417.

A temperature detection method of the heater 300 will be explained next. The temperatures detected by the thermistors T1-1 to T1-4 of the thermistor block TB1 are detected at the CPU 420 as Th1-1 to Th1-4 signals, with voltage division of the thermistors T1-1 to T1-4 and resistors 451 to 454. Similarly, the temperatures detected by the thermistors T2-5 to T2-7 of the thermistor block TB2 are detected at the CPU 420 as Th2-5 to Th2-7 signals, with voltage division of the thermistors T2-5 to T2-7 and resistors 465 to 467.

In the internal processing of the CPU 420, the power to be supplied is calculated on the basis of a difference between a control temperature of the thermistors that detect the temperature of the heating blocks and the currently detected temperature of the thermistors. For instance the power to be used is calculated on the basis of PI control. The power is converted to a control level of phase angle (phase control) and/or wavenumber (wavenumber control) corresponding to the power to be supplied, and the triacs 411 to 417 are controlled on the basis of those control conditions.

A relay 430 and a relay 440 are used as means for cutting off power to the heater 300 in the case of overheating of the heater 300 for instance due to a malfunction.

The circuit operation of the relay 430 and the relay 440 will be explained next. When the RLON signal is in a High state, the transistor 433 is turned on, the secondary coil of the relay 430 is energized from the power source voltage Vcc, and the primary contact of the relay 430 is turned on. When the RLON signal is in a Low state, the transistor 433 is turned off, flow of current from the power source voltage Vcc to the secondary coil of the relay 430 is interrupted, and the primary contact of the relay 430 is turned off. Similarly, when the RLON signal is in a High state, the transistor 443 is turned on, the secondary coil of the relay 440 is energized from the power source voltage Vcc, and the primary contact of the relay 440 is turned on. When the RLON signal is in a Low state, the transistor 443 is turned off, flow of current from the power source voltage Vcc to the secondary coil of the relay 440 is interrupted, and the primary contact of the relay 440 is turned off. Resistors 434, 444 are resistors that limit the base current of the transistors 433, 443.

The operation of a safety circuit in which the relay 430 and the relay 440 are used will be explained next. In a case where any one of the temperatures detected by the thermistors Th1-1 to Th1-4 exceeds a respective predetermined value that is set, the comparison portion 431 operates the latch portion 432, and the latch portion 432 latches an RLOFF1 signal at a Low state. When the RLOFF1 signal is in a Low state, the transistor 433 is kept in an OFF state even when the CPU 420 sets the RLON signal to a High state, and accordingly the relay 430 can be maintained in an OFF state (safe state). In a non-latched state, the latch portion 432 sets the RLOFF1 signal to an open-state output. Similarly, in a case where any one of the temperatures detected by the thermistors Th2-5 to Th2-7 exceeds a respective predetermined value that is set, the comparison portion 441 operates the latch portion 442, and the latch portion 442 latches an RLOFF2 signal at a Low state. When the RLOFF2 signal is in a Low state, the transistor 443 is kept in an OFF state even when the CPU 420 sets the RLON signal to a High state; accordingly, the relay 440 can be maintained in an OFF state (safe state). In a non-latched state, similarly, the latch portion 442 sets the RLOFF2 signal to an open-state output.

5. Heater Control Method According to Image Information

Figure 5:
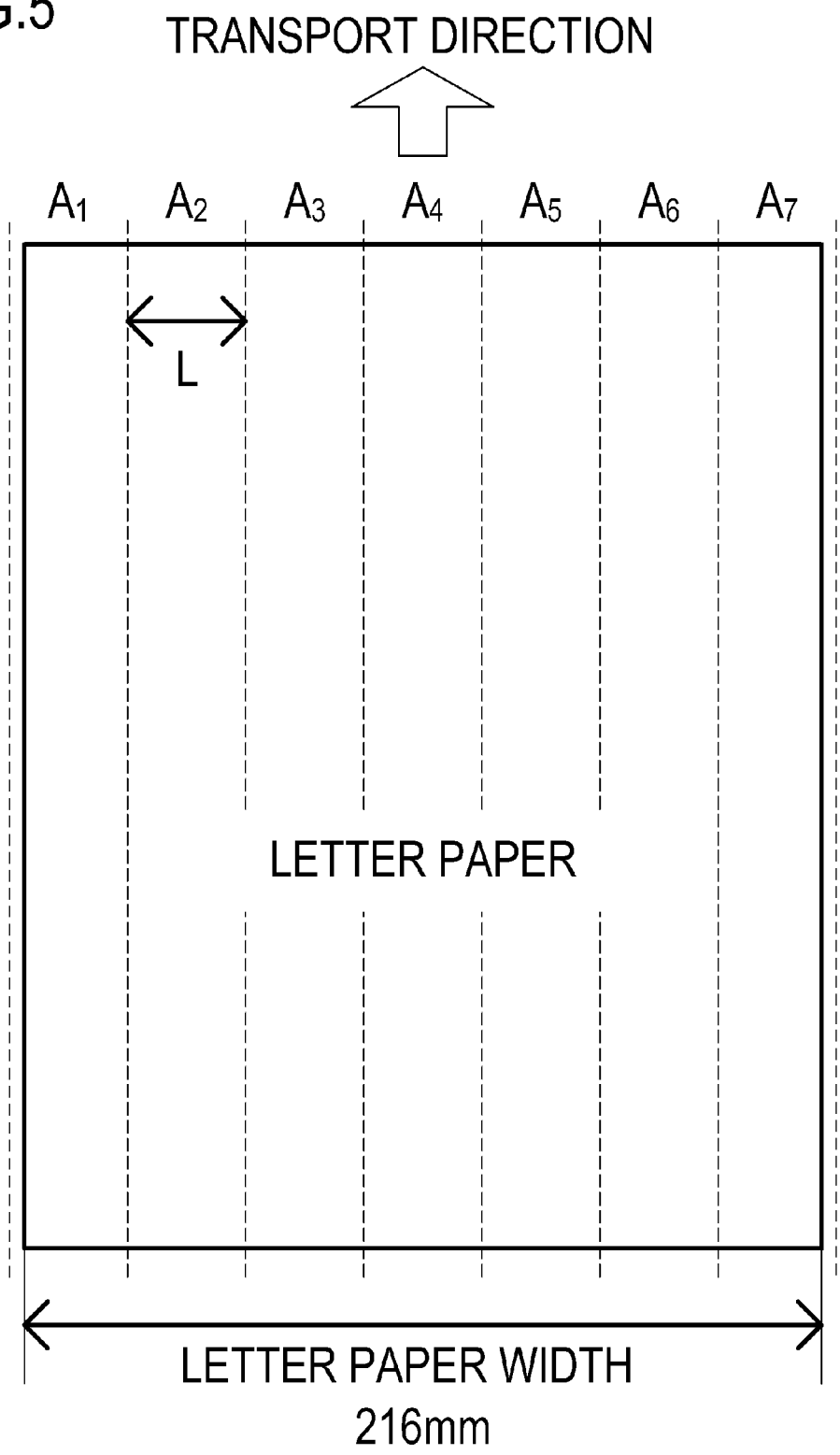
FIG. 5 is a diagram illustrating heating regions $A_1$ to $A_7$.

FIG. 5 is a diagram illustrating seven heating regions $A_i$ ($A_i$ in generalized notation, where i=1 to 7) being divisions in the longitudinal direction, of the present embodiment. The heating regions are depicted compared to a paper of letter size. The heating regions $A_1$ to $A_7$ correspond to the heat generation blocks $HB_1$ to $HB_7$, such that the heating region $A_1$ is heated by the heat generation block $HB_1$, and the heating region $A_7$ is heated by the heat generation block $HB_7$. The control temperature of the thermistors that detect the temperatures of the heat generation blocks $HB_1$ to $HB_7$ is set, and switched, in heating regions $A_i$ units. In Embodiment 1, the width of each of the heating regions $A_i$ is identical to the length, in the transport direction, of each page of the recording material that is outputted, the heating regions $A_i$ being set in recording material units that are outputted. Accordingly, the control temperature of the heat generation blocks $HB_1$ to $HB_7$ is switched for each page of the recording material.

Image data from an external device such as a host computer is received by the video controller 120 of the image forming apparatus, and the received image data is converted to bit map data, by image processing, in the video controller 120. The number of pixels in the image forming apparatus of the present embodiment is 600 dpi, and the video controller 120 creates bit map data (image density data of each CMYK color) in accordance with the number of pixels. The video controller 120 converts an image density of each CMYK color to a toner amount conversion value D (%), for each dot, on the basis of the bit map data. Specifically, the video controller 120 converts image density to the toner amount conversion value D in accordance with the method described below.

Herein d(C), d(M), d(Y) and d(K), which are image densities of C, M, Y, and K for each dot, are acquired from image data resulting from conversion to CMYK image data. Further, d(CMYK) which is a total sum value of the image densities d(C), d(M), d(Y), d(K) of each color, is calculated for each dot.

The image information in the video controller 120 is an 8-bit signal, and the image densities d(C), d(M), d(Y), d(K) per toner color are expressed in a range of a minimum density 00h to a maximum density FFh. Further, d(CMYK), which is a total sum value of the foregoing, is an 8-bit signal. The d(CMYK) value is converted to the toner amount conversion value D (%).

Specifically, conversion is performed with the minimum image density 00h per toner color set to 0%, and the maximum image density FFh set to 100%. The toner amount conversion value D (%) corresponds to the actual toner amount per unit surface area on the recording material P. In the present embodiment, the toner amount on the recording material for the image density FFh is set to 0.50 $mg/cm^2$=100%.

Herein d(CMYK) is the total value of the plurality of toner colors, such that in some instances the value of the toner amount conversion value D (%) exceeds 100%. In the image forming apparatus of the present embodiment the toner amount on the recording material P is adjusted so that 1.15 $mg/cm^2$ (corresponding to 230% in the toner amount conversion value D) is an upper limit, for an all-solid image.

The control portion 113 acquires a toner amount conversion value D (%) resulting from conversion from the d(CMYK) value which is density information, for all the dots of all the images within the heating regions $A_i$. Respective values of control temperature (control target temperatures) $T_1$ to $T_7$ ($T_i$ in generalized notation, where i=1 to 7) of the heat generation blocks $HB_i$ of the heater 300, are temporarily set on the basis of a maximum value $D_{MAX}(i)$ (%) of the toner amount conversion value D (%) at each heating region $A_i$. The entirety of the image that is formed on the recording material P is divided into heating regions, the maximum value of image density within each divisional image region is acquired, and a control heating amount of each heating region is temporarily set on the basis of the acquired maximum value of image density. In this case each control temperature $T_i$ temporarily set is a heating temperature as a control heating amount.

Figure 6:
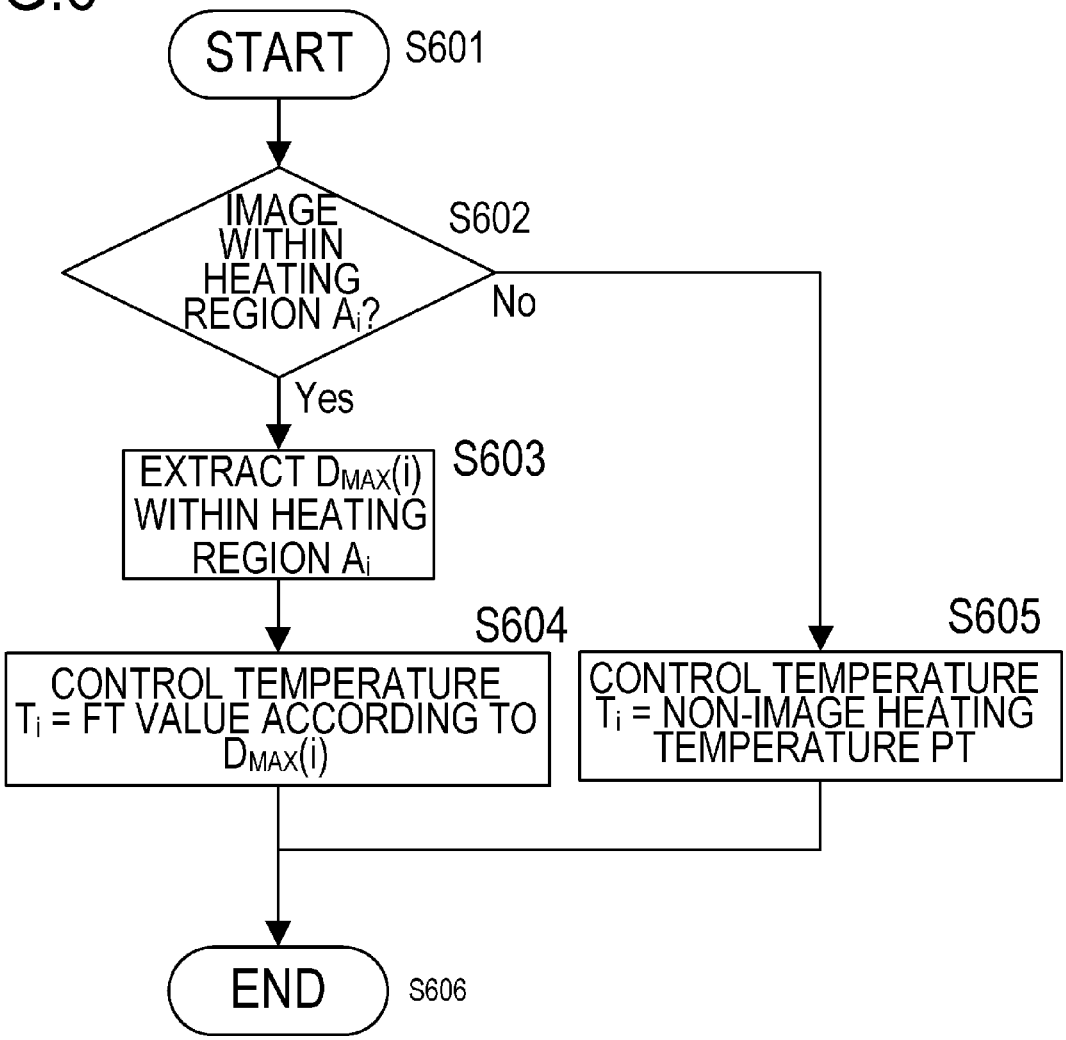
FIG. 6 is a diagram illustrating a toner amount heating temperature setting flow of an embodiment.

A method for calculating the control temperatures $T_i$ of the heating regions will be explained next with reference to FIG. 6. FIG. 6 is a diagram illustrating a toner amount heating temperature setting flow in which a maximum value $D_{MAX}(i)$ of a toner amount conversion value D of the image within each heating region (for instance $A_i$) is acquired, and there is set a control temperature $T_i$ according to the acquired maximum value $D_{MAX}(i)$. The above flow is controlled by the control portion 113.

A toner amount heating temperature setting flow starts in S601.

In S602 it is checked whether an image is present within each heating region $A_i$; if no image is present, the process proceeds to S605, and a value of a non-image heating temperature PT is set as the control temperature $T_i$ for the heating region $A_i$, and the process flow ends.

In S603, a toner amount converted maximum value $D_{MAX}$ (i) (%), which is a maximum value, is extracted from the toner amount conversion values D (%) of all the dots within the heating region $A_i$.

Once a toner amount converted maximum value $D_{MAX}(i)$ is obtained in S603, then in S604 a value (details set out below) of scheduled heating temperature $FT_i$ which is a heating temperature corresponding to the toner amount converted maximum value $D_{MAX}(i)$ is set as the control temperature $T_i$ for the heating region $A_i$, and the flow ends.

The above toner amount heating temperature setting flow is performed for heating regions $A_1$ to $A_7$. For each control temperature $T_1$ to $T_7$ there is set a value of scheduled heating temperature $FT_i$ corresponding to a respective toner amount converted maximum value $D_{MAX}(i)$; alternatively, the value of the non-image heating temperature PT is set for heating regions in which an image is not formed.

Table 1 illustrates a relationship between toner amount converted maximum value $D_{MAX}(i)$ and scheduled heating temperature FT in the present embodiment.

TABLE 1

| $D_{MAX}(i)(\%)$ | FT(° C.) |
|---|---|
| $200 \leq D_{MAX} \leq 230$ | 215 |
| $170 \leq D_{MAX} < 200$ | 208 |
| $140 \leq D_{MAX} < 170$ | 202 |
| $100 \leq D_{MAX} < 140$ | 196 |
| $0 < D_{MAX} < 100$ | 190 |

In the present embodiment the scheduled heating temperature FT is variable, over 5 stages, according to the toner amount converted maximum value $D_{MAX}(i)$. In Embodiment 1 the scheduled heating temperature FT can vary stepwise in accordance with the toner amount converted maximum value $D_{MAX}(i)$, but the scheduled heating temperature FT is not limited thereto.

A high temperature is set as the scheduled heating temperature FT, so that toner melts sufficiently, for images having a large toner amount converted maximum value $D_{MAX}(i)$ and a large amount of toner.

The non-image heating temperature PT for heating regions in which an image is not formed is set to a value (120° C. in the present embodiment) of temperature that is lower than the scheduled heating temperature FT, being the temperature of heating of the heating regions in which an image is formed.

Figure 7:
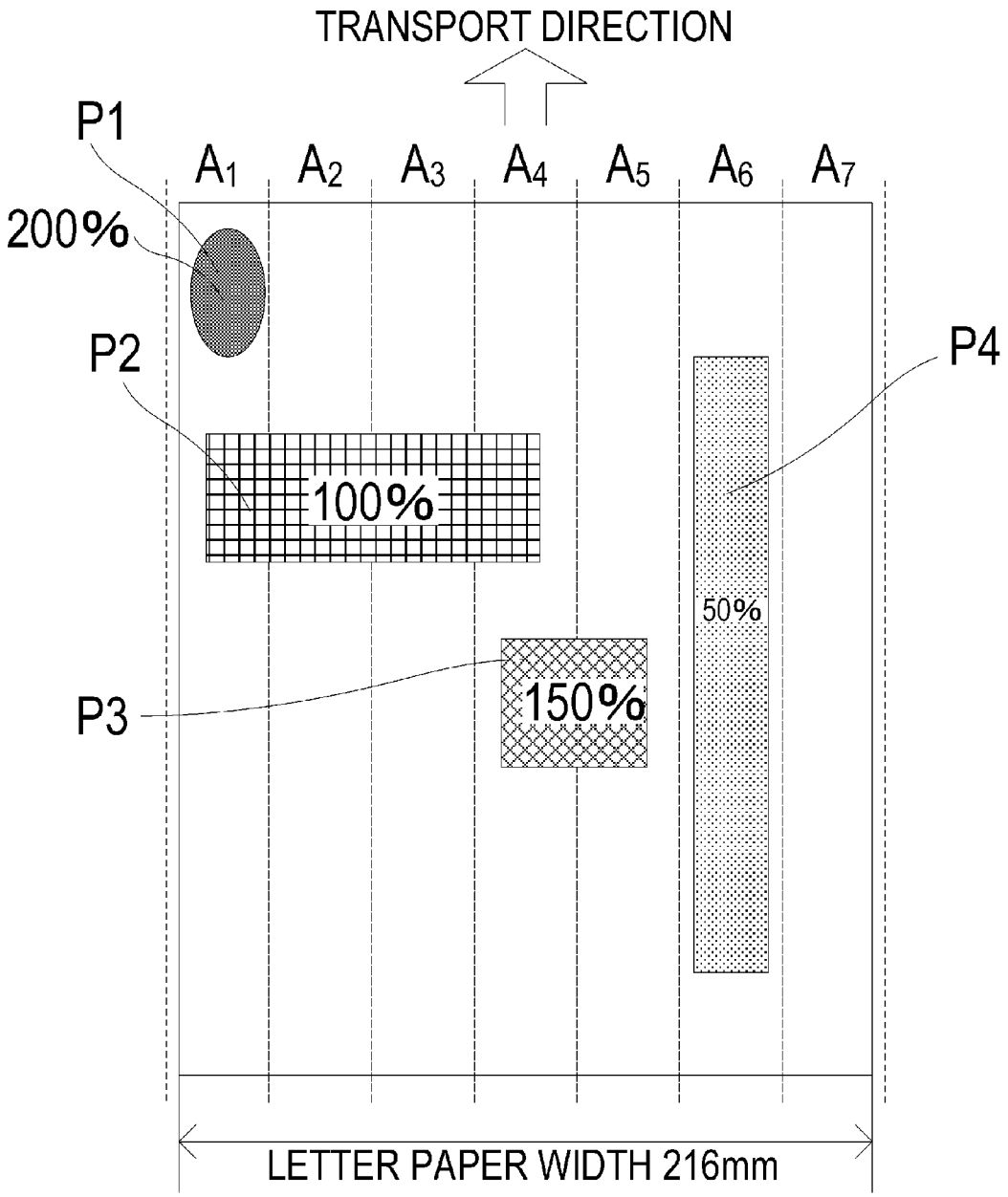
FIG. 7 is a diagram illustrating an image example of an embodiment.

A more detailed explanation follows next taking the images illustrated in FIG. 7 as an example.

FIG. 7 illustrates an instance where images P1 to P4 (Pk in generalized notation, where k=1 to 4) are formed on letter size paper.

For the sake of simplicity, all images P1 to P4 are images with uniform density of cyan (C), magenta (M) and yellow (Y). Values resulting from converting the image densities of images P1, P2, P3, P4 to toner amount conversion values D (%) are assumed herein to be 200%, 100%, 150% and 50%, respectively.

To output the images of FIG. 7A, the control temperature $T_i$ and the toner amount converted maximum value $D_{MAX}$ for the heating regions $A_1$ to $A_7$, set in the flow of FIG. 6, are herein set to the values given in Table 2.

TABLE 2

| Heating region | $A_1$ | $A_2$ | $A_3$ | $A_4$ | $A_5$ | $A_6$ | $A_7$ |
|---|---|---|---|---|---|---|---|
| Toner amount converted maximum value $D_{MAX}$ | 200% | 100% | 100% | 150% | 150% | 50% | No image |
| Control temperature $T_i$ [° C.] | 215 | 196 | 196 | 202 | 202 | 190 | 120 |

Each control temperature $T_i$ is set in accordance with the toner amount converted maximum value $D_{MAX}(i)$ of each heating region $A_i$, as a result of the flow illustrated in FIG. 6; thereafter, images are extracted, and intra-image temperature correction control is executed for each image. In the present embodiment the images Pk are identified, and intra-image temperature correction control is performed for each image Pk.

In the present embodiment the following method is resorted to as the method for identifying the images Pk.

The video controller 120 performs image conversion of 600 dpi bit map data according to a 3.13 mm (74 dot) mesh size. The maximum value of toner amount conversion value D (%) of all the dots in the mesh is treated as the density of the mesh. The video controller 120 detects the presence or absence of an image, in each mesh, in the mesh image obtained by the image conversion, and detects regions surrounded by a mesh having a density of 0 on four sides, to acquire contour information about the images. Images Pk that are present continuously are then identified on the basis of the acquired contour information.

Figure 8A:
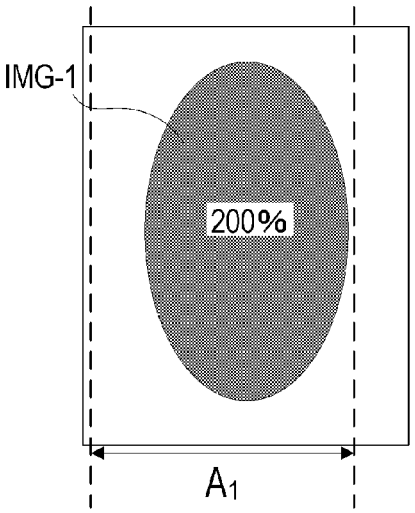
FIGS. 8A, 8B, and 8C are a set of diagrams illustrating an image example of an embodiment.

FIG. 8A is an enlarged-view diagram of the vicinity of image P1 on the 600 dpi bit map data of FIG. 7.

Figure 8B:
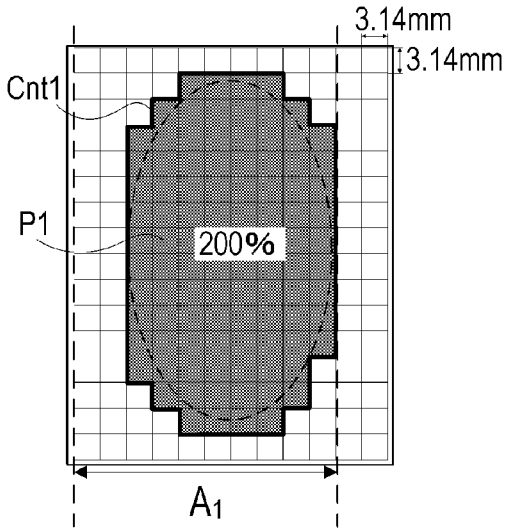

FIG. 8B is an enlarged-view diagram illustrating a mesh image in the vicinity of image P1, obtained through image conversion.

Figure 8C:
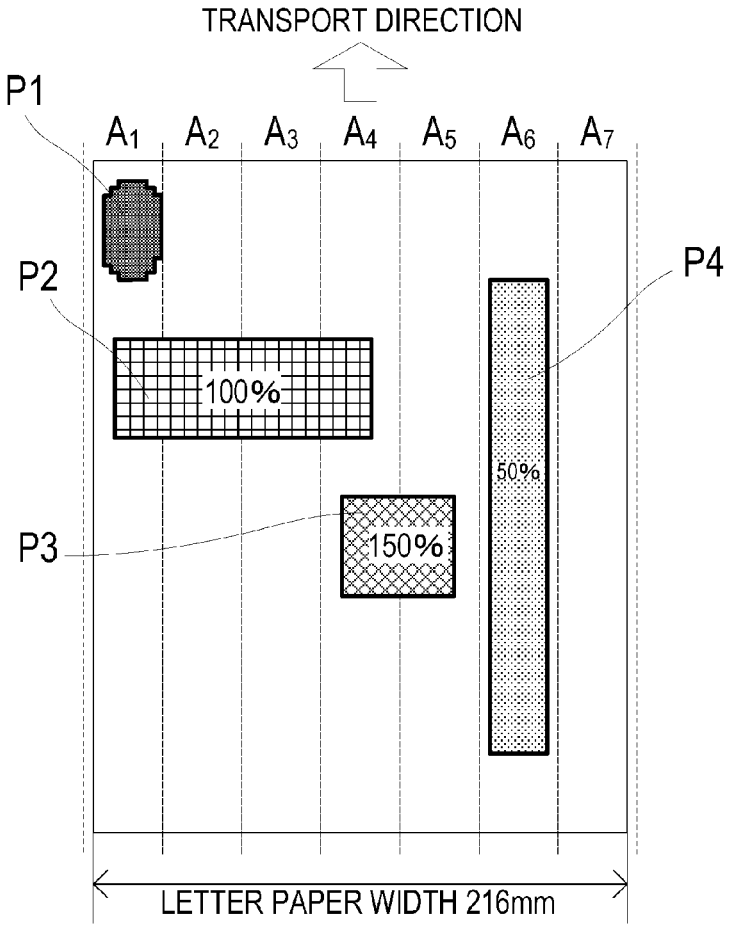

FIG. 8C is a diagram illustrating a mesh image of all the images illustrated in FIG. 7.

Image P1 illustrated in FIG. 8A is converted into a partitioned mesh image, as illustrated in FIG. 8B, as a result of image analysis performed by the video controller 120.

The video controller 120 acquires contour information Cnt1 illustrated in FIG. 8, to identify image P1.

All the images Pk illustrated in FIG. 7 are identified and recognized, in accordance with the above method, as images P1 to P4 in FIG. 8C.

The method for separating and extracting images is not limited to the above one. For example, connections between the images may be determined on the basis of connections for each pixel, or connections for each dither processing unit. In addition to the extraction method of the present embodiment, the density of each mesh may be divided and organized in stages, and the image may be further separated and extracted for each stage.

Intra-image temperature correction control involves correcting control temperature $T_i$, for the images Pk identified as described above, so that there are reduced temperature differences within each heating region in which a respective image is present. Intra-image temperature correction control will be explained next.

In intra-image temperature correction control there is executed, for each image, control temperature correction of the control heating temperatures $T_i$ determined in the toner amount heating temperature flow.

In intra-image temperature correction control a difference is calculated between the control temperatures $T_i$ (Pk) within the heating regions in which an image Pk is present, and a maximum value TMAX (Pk) which is the largest control temperature $T_i$ (Pk) from among the control temperatures $T_i$ (Pk) of the heating region in which image Pk is present. In a case where the differences exceed a specified amount Δx, the control temperatures $T_i$ (Pk) are corrected so that the differences are equal to or smaller than the specified amount Δx.

Specifically, in a case where the image formed on the recording material P includes a series of image portions (images Pk) formed across a plurality of heating regions, then correction is performed in such a manner that differences between a maximum value and minimum value of control target temperatures among the plurality of heating regions in which each image portion is present lie within a predetermined range.

The specified amount Δx must be set to a value that allows for a gloss value difference within the image. As a result gloss differences within the image can be reduced, for each image, by reducing heating differences within the image. Correction is performed for all the images in such a manner that the control temperature difference within the image becomes equal to or smaller than the specified amount Δx. In the present embodiment, the specified amount Δx is set to 5, and correction is performed so that a heating temperature difference within a same image is allowed up to 5° C. However, these parameters are determined taking into consideration for instance also toner characteristics, and the values given above are not limiting.

In the flow of intra-image temperature correction control, the notation of image Pu (where u denotes image number, and takes on a value of u=1 to m in a case where the number of images is m) is adopted herein in order to distinguish the foregoing from an image Pk, as the generalized notation.

Figure 9:
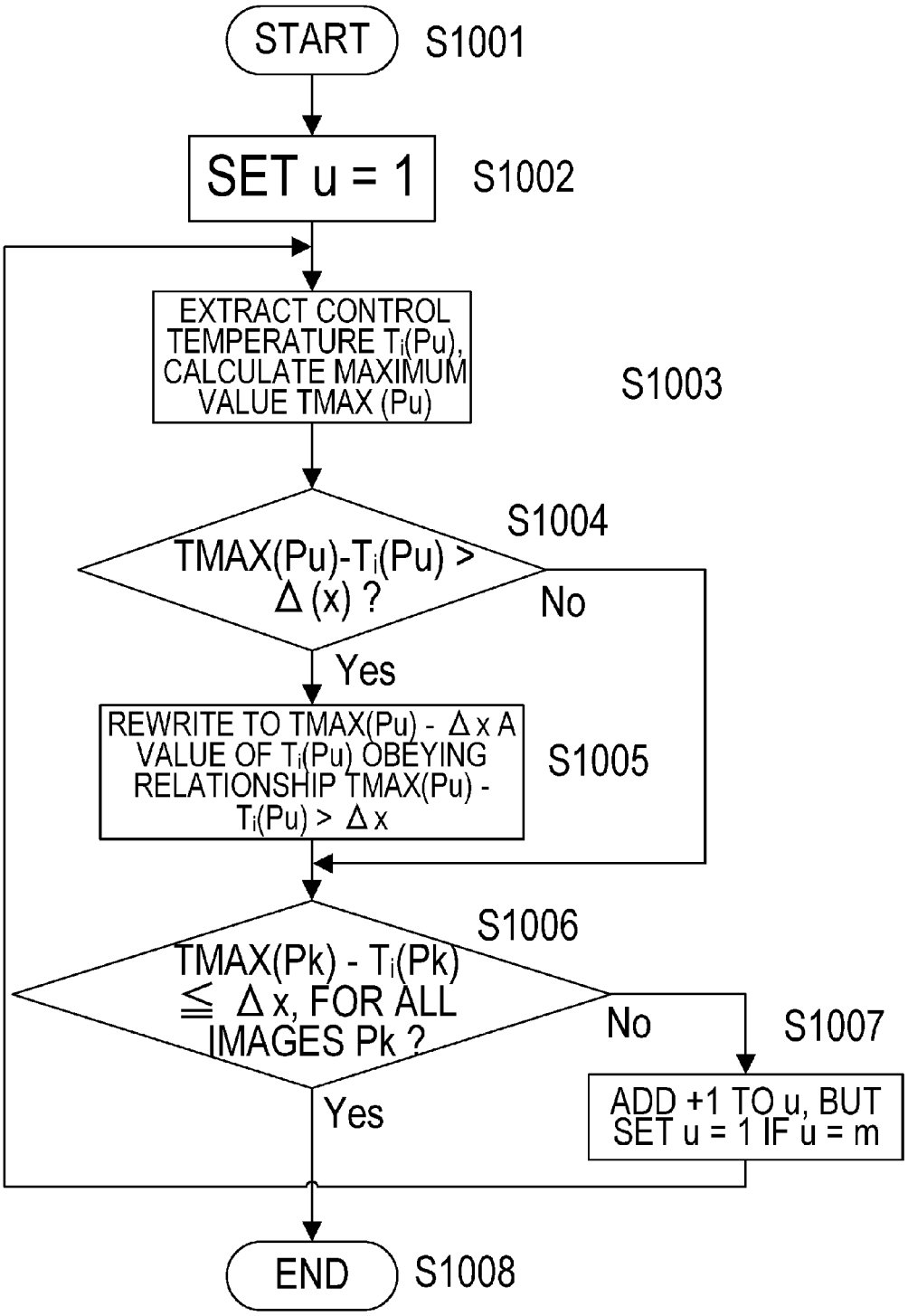
FIG. 9 is a diagram illustrating intra-image temperature correction control of an embodiment.

FIG. 9 is a diagram illustrating the flow of intra-image temperature correction control. Table 3 illustrates control temperatures $T_i$ prior to the start of intra-image temperature correction control and after the end of intra-image temperature correction control, for images P2 and P3.

TABLE 3

| Heating region | $A_1$ | $A_2$ | $A_3$ | $A_4$ | $A_5$ | $A_6$ | $A_7$ |
|---|---|---|---|---|---|---|---|
| $T_i$ (° C.) before correction | 215 | 196 | 196 | 202 | 202 | 190 | 120 |
| $T_i$ (° C.) after correction in P2 | 215 | 210 | 210 | 210 | 202 | 190 | 120 |
| $T_i$ (° C.) after correction in P3 | 215 | 210 | 210 | 210 | 205 | 190 | 120 |

Figure 10A:
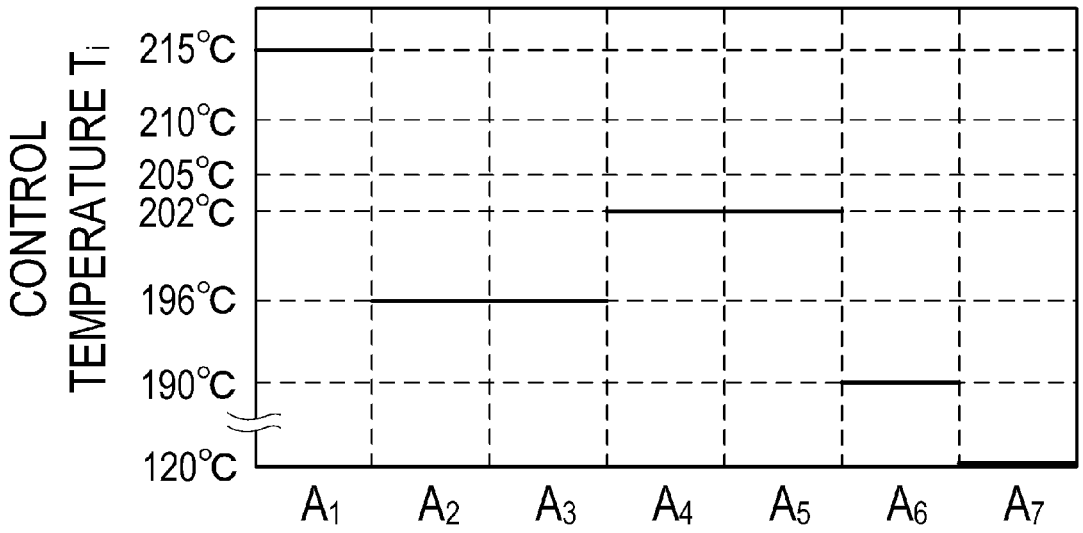
FIGS. 10A and 10B are a set of graphs illustrating control temperature before and after intra-image temperature correction control of an embodiment.
Figure 10B:
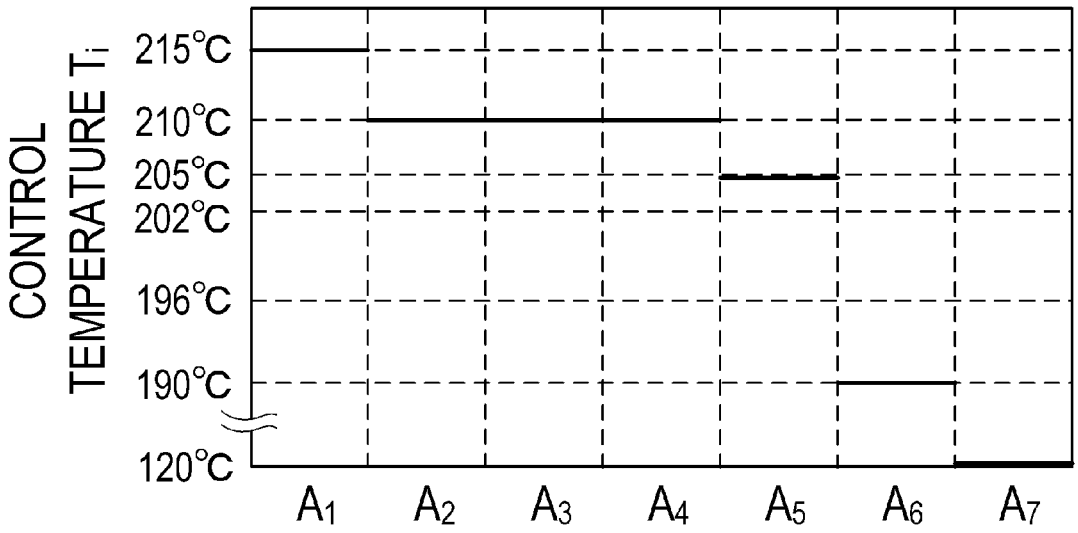

FIG. 10 is a set of diagrams of graphs illustrating control temperature $T_i$ for heat generation regions $A_i$ before and after intra-image temperature correction control, in an example where the image of FIG. 7 is outputted. FIG. 10A illustrates control temperatures $T_i$ of the heat generation regions $A_i$ before intra-image temperature correction control, and FIG. 10B illustrates control temperatures $T_i$ of the heat generation regions $A_i$ after intra-image temperature correction control. The intra-image temperature control flow will be explained next with reference to FIG. 9 and Table 3. The above flow is controlled by the control portion 113.

Firstly the flow starts from S1001, after the end of the toner amount heating temperature flow.

In S1002, a value of 1, as an initial value, is set for the image number u, and an image Pu is selected as the image for execution of intra-image temperature correction control. Herein image P1 is selected, and it is determined to execute intra-image temperature correction control from image P1.

In S1003 the control temperatures $T_i$ (Pu) within the heating regions in which image Pu is present are extracted, and there is calculated a maximum value TMAX (Pu) from among the extracted control temperatures $T_i$ (Pu). The control temperature $T_1$ within the heating region in which image P1 is present is 215° C., and 215° C. is thus calculated as TMAX (P1).

In S1004 there is calculated a respective difference between the maximum value TMAX (Pu) and each control temperature $T_i$ (Pu), and it is determined whether the difference is larger than Δx. If larger than Δx, the process proceeds to S1005, and the values of the control temperature $T_i$ (Pu) for which the difference with respect to TMAX (Pu) is larger than Δx is rewritten to a value of (TMAX (Pu)−Δx). As a result the control temperature differences between the heating region with maximum value TMAX (Pu) and heating regions and in which image Pu is present, including the former heating region, become equal to or smaller than Δx. In a case where the difference between the maximum value TMAX (Pu) and a respective control temperature $T_i$ (Pu) is equal to or smaller than Δx, the process skips to S1005, and proceeds to S1006. The control temperatures $T_i$ (P1) are herein just $T_1$ alone, i.e. 215° C. Accordingly, the differences are all 0 and thus smaller than 5, which is Δx, since TMAX (P1) as well is 215. In consequence, the process proceeds to S1006.

In S1006 it is determined whether the differences between the maximum value TMAX (Pk) of each image Pk and the control temperatures $T_i$ (Pk) are smaller than Δx, for all images Pk (k=1 to m). In a case where the above condition is met, the process proceeds to S1008, and the flow is stopped, since heating differences within the image have been successfully reduced to or below the specified amount. If the above condition is not met, the process proceeds to S1007. At this point in time the control temperatures $T_i$ are identical to the values prior to correction set out in Table 3. For image P2, the maximum value TMAX (P2) is 215 of $T_1$, and the differences with respect to $T_2$ to $T_4$, which are the control temperatures $T_i$ (P2), are larger than 5. Accordingly, the control temperature for image P2 must be corrected in order to eliminate gloss value differences. In consequence, the process proceeds to S1007.

In S1007, 1 is added to u which is the image number, and the process returns to S1003, in order to execute the intra-image temperature correction flow now for image P2.

In S1003 executed for image P2, values of $T_1$, $T_2$, $T_3$, $T_4$ of the control temperatures $T_i$ (P2) are extracted, the values being 215, 196, 196 and 202, respectively. The value of 215 of $T_1$ is calculated as the maximum value TMAX (P2). In S1004, differences between the maximum value TMAX (P2) and the temperatures $T_2$, $T_3$, $T_4$ which are the control temperatures $T_i$ (P2) are calculated as 19, 19 and 13, respectively. Then $T_2$, $T_3$ and $T_4$ are rewritten to the value of 210, which is (TMAX (P2)−Δx) in S1005, since the above differences are larger than the specified amount 5. The control temperatures $T_i$ at this point in time are corrected values for P2, as given in Table 3.

In S1006 there is checked once again, for all the images, whether the control temperature differences within the images satisfy being no greater than 5° C. As Table 3 reveals, the maximum value TMAX (P3) of image P3 is 210 for $T_4$, i.e. a difference with respect to $T_5$ as the control temperature $T_i$ (P3) is 210−202=8, which is larger than 5 as the specified amount. Accordingly, the process proceeds to S1007, and correction of image P3 is initiated.

The control temperatures $T_4$ and $T_5$ of the heating regions in which image P3 is present are corrected in accordance with the flow of S1003 to S1005, in the same way as above, and the control temperature $T_5$ is rewritten to a corrected value for P3, as given in Table 3.

Thereafter in S1006 it is determined, for all images, that the differences between the maximum value TMAX (Pk) of the images Pk and the control temperatures $T_i$ (Pk) are smaller than Δx, the process proceeds to S1008, and the flow is terminated.

In a case where the image number u is a last number m, an initial image number 1 is set, in S1007, to the image number u, and the flow is repeated sequentially again, from image P1.

A value of (TMAX (Pu)−Δx) has been used as the value for rewriting in S1005, but the value is not limited thereto, and a value equal to or greater than (TMAX (Pu)−Δx) or equal to or smaller than TMAX (Pu) may be set herein.

That is, each control heating amount $T_i$ (Pk) for which a difference with respect to a maximum value of control heating amount $T_i$ (Pk) exceeds a specified amount is corrected to a value equal to or greater than a value resulting from subtracting a specified amount from the maximum value of the control heating amounts $T_i$ (Pk), and equal to or smaller than the maximum value of the control heating amounts $T_i$ (Pk).

The manner in which adopting the configuration of the present embodiment allows improving on issues in conventional instances will be explained next by way of contrasting against a comparative example. A comparison will be made with respect to the situation of printing of the image in FIG. 7 as an example.

The features in the comparative example are identical to those of the present embodiment, except for configuration of the control portion. Execution of the toner amount heating temperature flow in the control portion 113 is likewise identical to that of the present embodiment. The comparative example differs from the embodiment in that the comparative example involves no intra-image temperature correction control, and relies on a different correction scheme. Correction control in the comparative example will be explained next.

In the comparative example the control temperatures $T_i$ and $T_{i+1}$ of two adjacent regions, namely heating region $A_i$ and heating region $A_{i+1}$ from among heating regions in which the image is formed, are compared after the end of the toner amount heating temperature flow. The control temperature T of the lower one is corrected by being rewritten to the value of the control temperature T of the higher one, so that the difference therebetween is no greater than 5° C.

In the image forming apparatus of the present embodiment and the comparative example it is assumed that when the temperature difference at the time of fixing of images of substantially identical color and density is greater than 5° C., a difference of 10% or higher as a gloss value arises that can be discriminated visually.

Accordingly, in the comparative example control is performed in accordance with Japanese Patent Application Publication No. 2018-124476, in such a manner that differences in gloss value between adjacent heating regions cannot be discriminated visually.

Table 4 sets out heating temperatures $T_i$ at heating regions in the case of printing of the images of FIG. 7, for the present embodiment and the comparative example.

TABLE 4

| | Control temperature | | | | | | |
|---|---|---|---|---|---|---|---|
| | $T_1$ | $T_2$ | $T_3$ | $T_4$ | $T_5$ | $T_6$ | $T_7$ |
| Present embodiment | 215 | 210 | 210 | 210 | 205 | 190 | 120 |
| Comparative example | 215 | 210 | 205 | 202 | 202 | 197 | 120 |

As Table 4 reveals, the heating temperature difference between adjacent heating regions is kept at 5° C. in the comparative example, and gloss value differences cannot be discriminated visually. Concerning gloss value differences within image P2, the difference between heating temperature $T_1$ and heating temperature $T_4$ of heating region $A_1$ and heating region $A_4$ is 13° C., and the heating temperature difference within the image is greater than 5° C. A significant difference in gloss value within image P2 in FIG. 7 arises as a result.

In the embodiment, no gloss values differences arise within the images P1 to P4, since there are no portions within the images in which the differences in the control temperatures $T_i$ between heating regions are larger than 5° C.

In Embodiment 1 the uniformity of gloss value of an output image can be increased as compared with that of the comparative example, which is a conventional example, in an image forming apparatus in which heating conditions of heat generation blocks provided in the longitudinal direction are adjusted in accordance with image information.

In the configuration explained above, the length of the heating regions $A_i$ in the transport direction is identical of the length, in the transport direction, of each page of the recording material that is outputted, and the control temperatures for heating of the heating regions $A_i$ are set in units of recording material that are outputted. However the width of the heating regions $A_i$ in the transport direction is not limited thereto, and may be modified and set as appropriate depending on the configuration involved.

The present embodiment involves setting and correcting a control target temperature, as a control heating amount, but the embodiment is not limited to such a configuration. For instance, a configuration may be adopted in which the control heating amount is specified according to the power that is supplied to the heater (for instance amount of energization in the heating elements (calculated power consumption amount) or the energization ratio of each heating element).

Further, an allowable value of the difference between heating temperatures in the heating regions in which an image is present continuously can be set to be variable for instance depending on the type of the recording material and the usage environment (environment information such as temperature and humidity). In a case for instance where gloss paper which affords higher image gloss is used as the recording material, the allowable value of difference in heating temperature may be set to be smaller than that when plain paper is used, to allow optimizing a balance between image gloss uniformity and power saving, depending on the type of the recording material.

In addition, execution of the intra-image temperature correction control described in the present embodiment may be limited to only instances where specified conditions are satisfied. Herein it may be decided to execute or not the intra-image temperature correction control on the basis of an image pattern, upon detection of the type of pattern of image Pk. Execution of the above intra-image temperature correction control may be omitted in a case for instance where a text image alone is to be formed. Gloss differences in text, if any, are not as noticeable as those of photographs or the like, and accordingly power savings can be increased without executing correction control.

Other Embodiments

There are also embodiments in which differences in gloss within images are given greater consideration than in Embodiment 1. One such instance will be explained next in the present embodiment. The basic configuration and operation of the image forming apparatus and image heating device of the present embodiment are identical to those of Embodiment 1. Therefore, functions and constituent elements identical to or corresponding to those in Embodiment 1 will be denoted with identical reference symbols, and a detailed explanation thereof will be omitted.

In the intra-image temperature correction control of the present embodiment an allowable value Δx of difference in heating temperatures within heating regions in which an image is continuously present is set to 0, and the heating temperatures within the heating regions in which the image is serially present are thus unified.

As a result, the continuously present image can be heated at the same temperature, and accordingly gloss differences within the image can be made smaller than those in Embodiment 1, even though energy savings are poorer than in the present embodiment.

Figure 11:
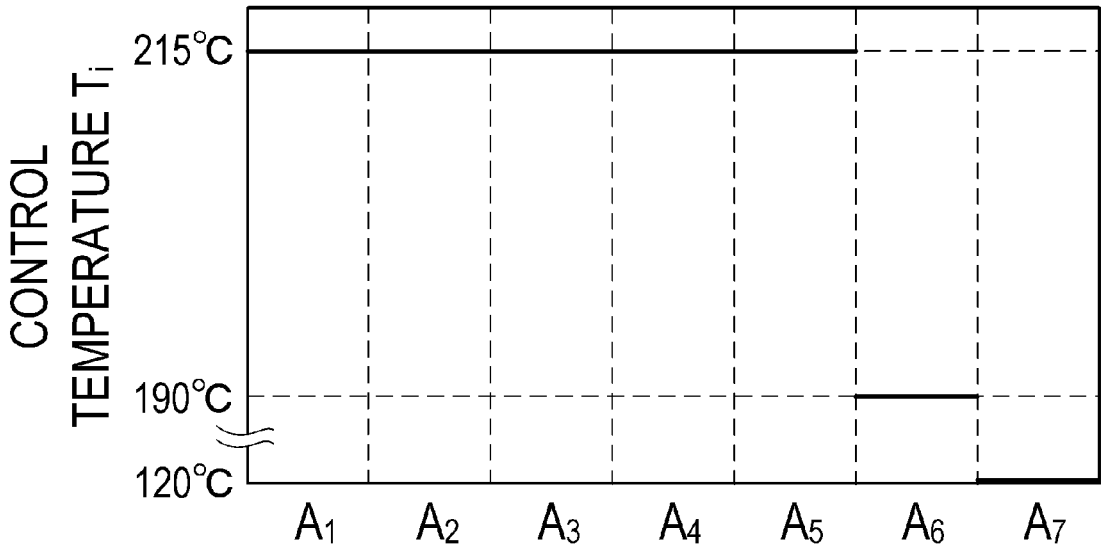
FIG. 11 is a diagram illustrating intra-image temperature correction control in another embodiment.
Figure 12A:
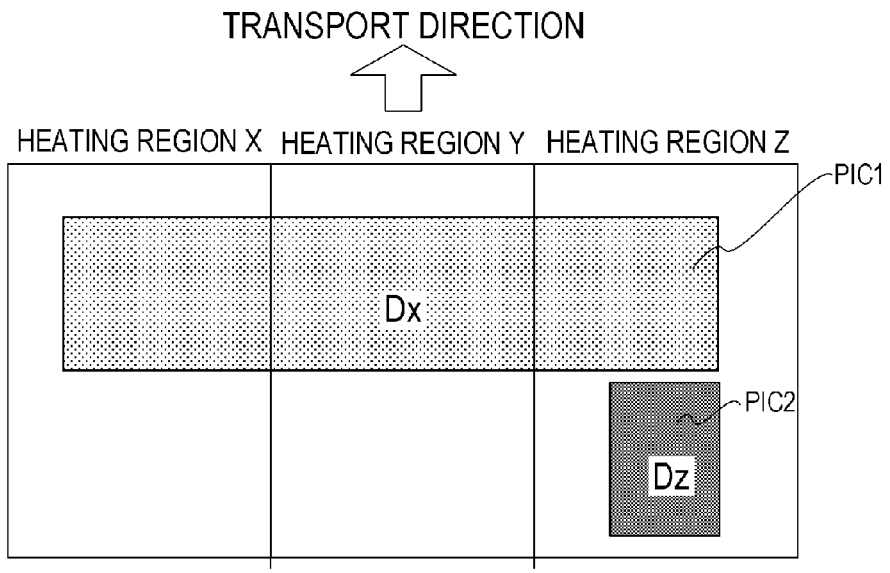
FIGS. 12A, 12B, and 12C are a set of diagrams representing heating regions, images, and control temperatures, divided in a longitudinal direction.
Figure 12B:
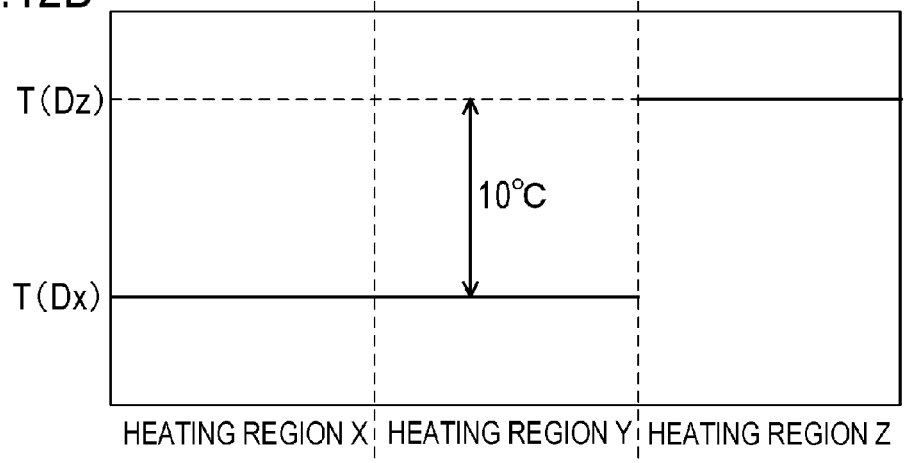
Figure 12C:
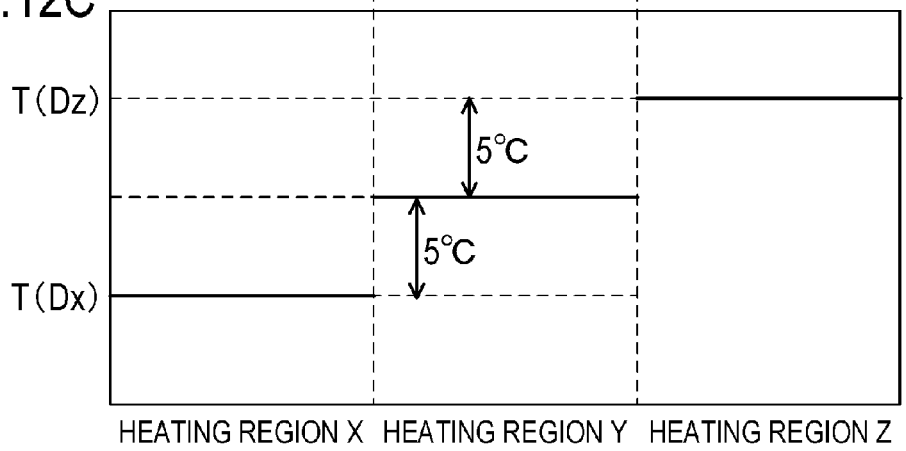

FIG. 11 illustrates a diagram of control temperature after intra-image temperature correction control in the present embodiment, at the time of outputting of the image of FIG. 7.

As illustrated in FIG. 11, heating regions $A_1$ to $A_4$ in which image P2 is present can be controlled in the present embodiment, in a unified fashion, to 215° C., unlike in Embodiment 1. As a result, intra-image gloss differences in image P2 that is present in the heating regions $A_1$ to $A_4$ are very small. The same is true of images P1, P3 and P4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-078025, filed on Apr. 16, 2019, which is hereby incorporated by reference herein in its entirety.

What is claimed is:

1. An image heating device comprising:

a heating unit including a heater for heating an image formed on a recording material, wherein the heater includes a substrate, and a plurality of heating elements dividedly provided on the substrate in a direction perpendicular to a transport direction of the recording material; and a control portion that controls power that is supplied to the plurality of heating elements, wherein the control portion acquires density information about the image for each of image regions resulting from dividing the image into a plurality of heating regions that are heated by the plurality of heating elements, sets respective control heating amounts for the plurality of heating regions, based on the acquired density information, and controls the power, wherein in a case where the image includes a contiguous image portion formed across two or more of the plurality of heating regions at a same density, the control portion controls the power by correcting the respective control heating amounts for the plurality of heating regions set in accordance with respective maximum densities of the image regions resulting from dividing the image into the plurality of heating regions, so that a difference between a maximum value and a minimum value of the control heating amounts among the two or more of the plurality of heating regions in which the image portion is heated from among the plurality of heating regions, lies within a predetermined range, and wherein the control portion corrects a control heating amount for which a difference with respect to the maximum value of the control heating amounts exceeds a predetermined specified amount among the respective control heating amounts of the two or more of the plurality of heating regions in which the image portion is heated from among the plurality of heating regions, to a value equal to or greater than a value resulting from subtracting the specified amount from the maximum value, and equal to or smaller than the maximum value.

2. The image heating device according to claim 1, wherein the specified amount is set based on at least one from among a type of the recording material and information about an environment in which the device is installed.

3. The image heating device according to claim 1, wherein the device further includes a tubular film, and wherein the heating unit is in contact with an inner surface of the film.

4. An image forming apparatus, comprising:

an image forming portion which forms an image on a recording material; and a fixing portion which fixes, to the recording material, the image formed on the recording material, wherein the fixing portion comprising:

a heating unit including a heater for heating an image formed on a recording material, wherein the heater includes a substrate, and a plurality of heating elements dividedly provided on the substrate in a direction perpendicular to a transport direction of the recording material; and a control portion that controls power that is supplied to the plurality of heating elements, wherein the control portion acquires density information about the image for each of image regions resulting from dividing the image into a plurality of heating regions that are heated by the plurality of heating elements, sets respective control heating amounts for the plurality of heating regions, based on the acquired density information, and controls the power, wherein in a case where the image includes a contiguous image portion formed across two or more of the plurality of heating regions at a given density, the control portion controls the power by correcting the respective control heating amounts for the plurality of heating regions set in accordance with respective maximum densities of the image regions resulting from dividing the image into the plurality of heating regions, so that a difference between a maximum value and a minimum value of the control heating amounts among the two or more of the plurality of heating regions in which the image portion is heated from among the plurality of heating regions, lies within a predetermined range, and wherein the control portion corrects a control heating amount for which a difference with respect to the maximum value of the control heating amounts exceeds a predetermined specified amount among the respective control heating amounts of the two or more of the plurality of heating regions in which the image portion is heated from among the plurality of heating regions, to a value equal to or greater than a value resulting from subtracting the specified amount from the maximum value, and equal to or smaller than the maximum value.

5. An image forming apparatus for forming an image on a recording material, comprising:

an image forming portion configured to form the image on the recording material;

a fixing portion configured to fix the image formed on the recording material to the recording material, the fixing portion includes a rotatable tubular film contacting the recording material, a heater provided in an inside space of the film and having a substrate, a first heating element provided on the substrate, and a second heating element provided on the substrate, wherein the first and second heating elements are divided in a longitudinal direction of the substrate perpendicular to a transport direction of the recording material, and are provided at positions adjacent to each other in the longitudinal direction of the substrate;

a first switch element connected to the first heating element;

a second switch element connected to the second heating element; and a control portion configured to control powers supplied to the first and second heating elements by controlling the first and second switch elements, the control portion controls the first switch element so that a first heating amount of a first heating region heated by the first heating element becomes a set first heating amount, and controls the second switch element so that a second heating amount of a second heating region heated by the second heating element becomes a set second heating amount, wherein the control portion sets the set first heating amount in accordance with a density of an image having a maximum density formed in the first heating region, and sets the set second heating amount in accordance with a density of an image having a maximum density formed in the second heating region, where in a case where a first image having a constant density and extending over the first heating region and the second heating region is formed, and a second image having a density higher than that of the first image is formed in the second region, and an image having a density higher than that of the first image is not formed in the first heating region, the control portion sets the set first heating amount and the set second heating amount so that a difference between the set first heating amount and the set second heating amount is within a predetermined range, and wherein the control portion reduces the set second heating amount to keep the difference between the set first heating amount and the set second heating amount within the predetermined range.

6. The image forming apparatus according to claim 5, wherein the control portion sets a target temperature as the heating amount.

7. The image forming apparatus according to claim 5, wherein the substrate is made of ceramic.

* * * * *